United States Patent [19]

Akaeda et al.

[11] Patent Number: 4,646,102

[45] Date of Patent: Feb. 24, 1987

[54] DEPLOYABLE ANTENNA REFLECTOR APPARATUS

[75] Inventors: Tadayoshi Akaeda; Yuko Yamamoto, both of Yokohama; Katsuki Kanaōka, Kawasaki, all of Japan

[73] Assignee: Kabushiki Kaisha Toshiba, Kawasaki, Japan

[21] Appl. No.: 780,888

[22] Filed: Sep. 27, 1985

[30] Foreign Application Priority Data

Sep. 28, 1984 [JP] Japan ..... 59-201901

[51] Int. Cl.[4] ..... H01Q 15/20

[52] U.S. Cl. ..... 343/915; 343/705; 343/880; 343/DIG. 2

[58] Field of Search ..... 343/705, 700, 912, 840, 343/915, 916, 878–883, DIG. 2; 126/438, 439

[56] References Cited

U.S. PATENT DOCUMENTS 3,618,101 11/1971 Emde et al. ..... 343/915 X 3,717,879 2/1973 Ganssle ..... 343/915

FOREIGN PATENT DOCUMENTS 55-42420 3/1980 Japan .

57-68072 4/1982 Japan .

*Primary Examiner*—Marvin L. Nussbaum

*Attorney, Agent, or Firm*—Cushman, Darby and Cushman

[57] ABSTRACT

A parabola antenna reflector incorporating an deploying apparatus of the invention has a disk shape having a predetermined radius of curvature. The reflector has a cross-shaped first reflector portion which extends to a peripheral portion of the reflector in the longitudinal direction, a pair of second reflector portions axially held at two sides of the first reflector portion to oppose each other and biased to open, and two pairs of third reflector portions axially held at two sides of each of the second reflector portions to oppose each other and biased to open. The pair of second reflector portions are held by a first locking mechanism in a folded state, and the two pairs of third reflector portions are held by second locking mechanisms in a folded state. The holding state of the second locking mechanisms is released when the folding state of the first locking mechanism is released and the second reflector portions begin to deploy.

10 Claims, 10 Drawing Figures

DEPLOYABLE ANTENNA REFLECTOR APPARATUS

BACKGROUND OF THE INVENTION

The present invention relates to a deployable antenna reflector mounted on a spacecraft and, more particularly, to a deploying apparatus of an antenna reflector which can be folded to be very compact in size so as to enhance payload characteristics of a spacecraft, and which can be deployed to a desired size after the spacecraft is released from a launch vehicle.

In recent years, demand has arisen for an parabola antenna reflector having a large diameter and high reflection precision for use with a spacecraft. A spacecraft is carried into space by a launch vehicle. However, the available storage space for the spacecraft in such a launch vehicle is small, and a large acceleration force is applied to the spacecraft during launch. For this reason, when an antenna reflector having a large diameter is mounted on the spacecraft, the reflector must be folded into a compact size in order to realize a feasible spacecraft storage with respect to the launch vehicle, and the overall reflector must be appropriately supported to prevent structural damage.

For this reason, two types of conventional deployable antenna reflectors are proposed. The reflector of the first type has a deployable reflecting surface formed by, e.g., a mesh film having a much flexibility, and the reflector of the second type has a foldable rigid reflecting surface with high reflecting precision. The reflector of the first type is suitable for large dimensions, but cannot provide improved reflector precision. In addition, a frequency band is limited less than several GHz. The reflector of the second type is suitable for high frequency band use and is recently receiving a lot of attention. However, the reflector is a so-called center-feed type; the peripheral portion of reflector is divided into a petal shape, and the respective portions are folded toward a central portion into a cylindrical shape for storage. Therefore, the reflector of this type having a large diameter requires a large storage space. Furthermore, since the reflector of this type must be deployed in two operations, the respective reflector portions cannot be synchronously deployed, nor can all the reflector portions be driven by a single driving apparatus.

SUMMARY OF THE INVENTION

It is a first object of the present invention to provide a deployable antenna reflector apparatus which is compact and thin when folded, and requires only small storage space in a launch vehicle, can withstand the vibration and shock induced by launching the vehicle, and whose reflector portions can be simultaneously opened by operating a single drive mechanism.

Furthermore, it is a second object of the present invention to provide a deployable antenna reflector apparatus wherein the antenna reflector is pivotal within a predetermined angular range when the reflector is mounted on a spacecraft, the reflector is inclined toward the spacecraft side when the spacecraft is stored in a launch vehicle, and the reflector can be raised to a predetermined angle at the same time when the reflector is deployed.

There is provided an deployable antenna reflector apparatus according to the present invention, comprising a cross-shaped first reflector portion which is a part of a divided disk-shaped reflector and which extends in a longitudinal direction to a peripheral portion of the reflector, a pair of second reflector portions which are parts of the divided disk-shaped reflector and are axially supported opposite to each other at two sides of the first reflector portion so as to be biased to open and to be deployable, two pairs of third reflector portions which are parts of the divided disk-shaped reflector and which are axially supported opposite to each other at two sides of each of the said pair of second reflector portions so as to be biased to open and to be deployable, a first locking mechanism for holding the pair of second reflector portions in a folded state, second locking mechanisms for holding the two pairs of third reflector portions in a folded state, and a releasing mechanism for releasing the second locking mechanisms subsequently after the pair of second reflector portions begin to deploy when the first locking mechanism is released.

There is provided another deployable antenna reflector apparatus according to the present invention, comprising a cross-shaped first reflector portion which is a part of a divided disk-shaped reflector and which extends in a longitudinal direction to a peripheral portion of the reflector, a pair of second reflector portions which are parts of the divided disk-shaped reflector and are axially supported opposite to each other at two sides of the first reflector portion so as to be biased to open and to be deployable, two pairs of third reflector portions which are parts of the divided disk-shaped reflector and which are axially supported opposite to each other at two sides of each of the pair of second reflector portions so as to be biased to open and to be deployable, a first locking mechanism for holding the pair of second reflector portions in a folded state, second locking mechanisms for holding the two pairs of third reflector portions in a folded state, a releasing mechanism for releasing the second locking mechanisms subsequently after the pair of second reflector portions begin to deploy when the first locking mechanism is released, supporting legs mounted on a back surface of the first reflector portion and having an end portion mounted on antenna mounting equipment to be pivotal within a predetermined angular range, an elastic member for applying a biasing force in a direction in which the supporting legs are separated from the antenna mounting equipment, and a third locking mechanism for holding the disk-shaped reflector folded by the first and second locking mechanisms while laying the reflector at the side of the antenna mounting equipment against the biasing force of the elastic member.

BRIEF DESCRIPTION OF THE DRAWINGS

The accompanying drawings exemplify a deployable apparatus of a parabola antenna reflector according to an embodiment of the present invention, in which.

DETAILED DESCRIPTION OF THE PREFERRED EMBODIMENTS

An embodiment of the present invention will be described with reference to the accompanying drawings.

Figure 1:
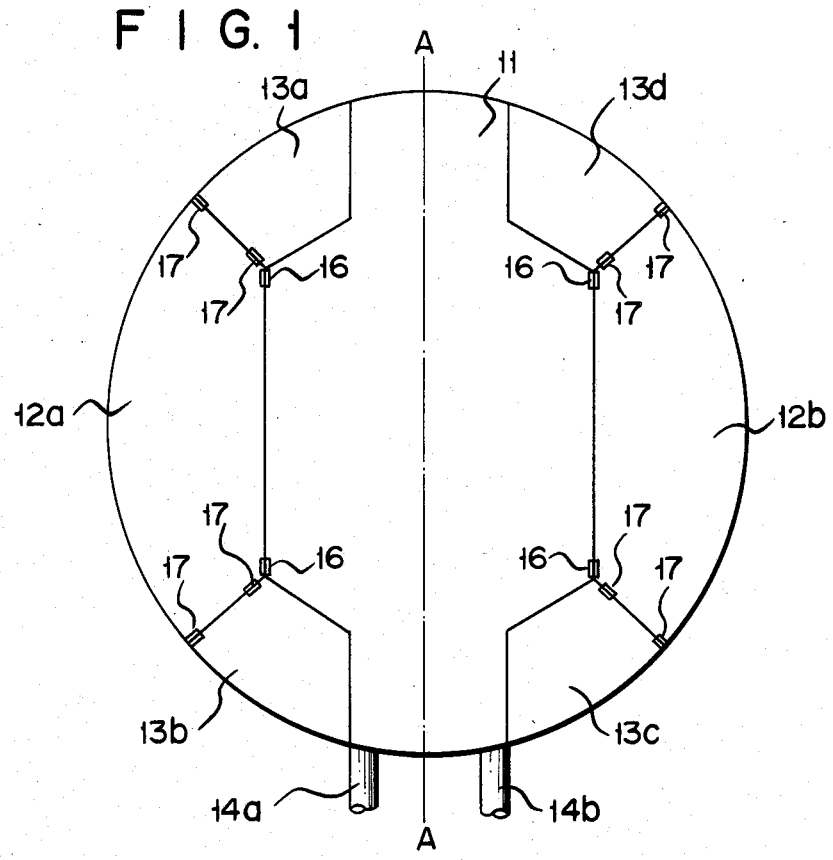
FIG. 1 is a front view of an antenna reflector in a deployed state to which the present invention is applied.
Figure 2:
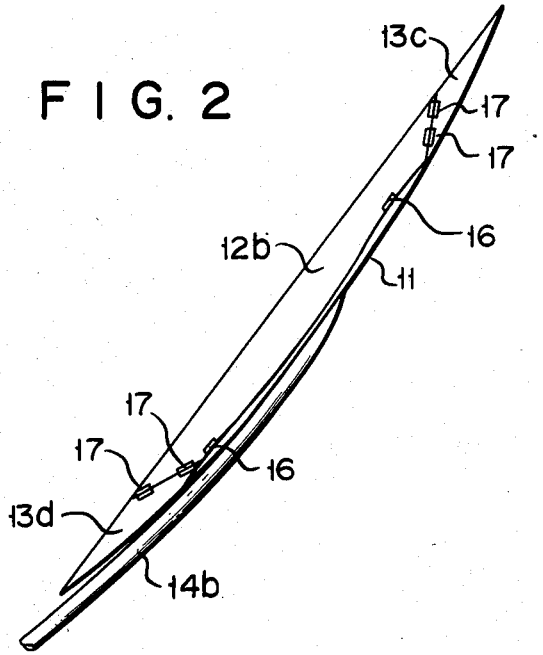
FIG. 2 is a side view of the antenna reflector of FIG. 1.
Figure 3:
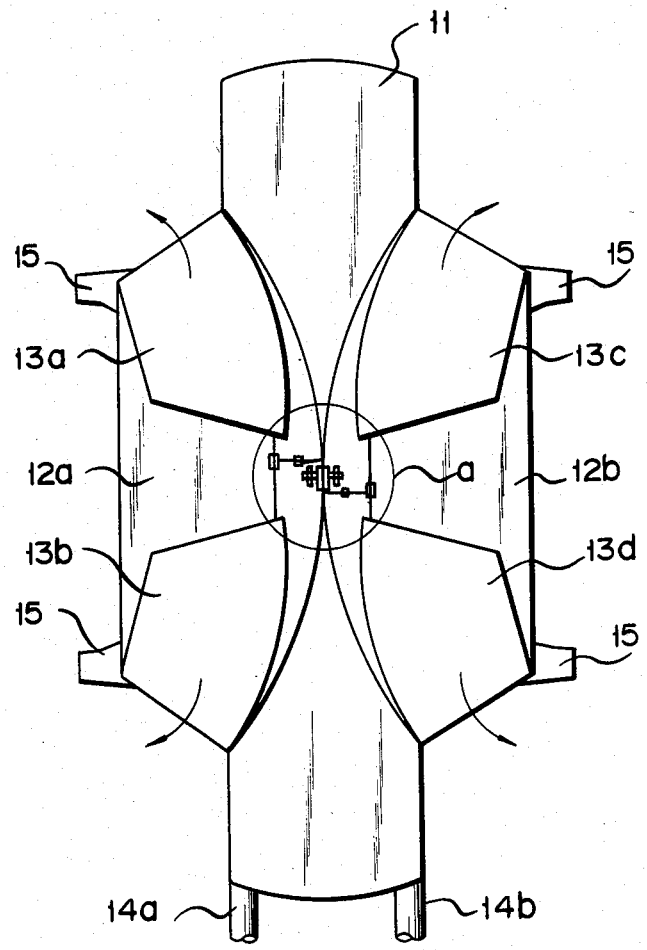
FIG. 3 is a front view of the antenna reflector in a folded state.

First, a deploying apparatus of a parabola antenna reflector to which the present invention is applied will be explained with reference to FIGS. 1 to 3. FIG. 1 is a front view of the antenna reflector in the deployed state, FIG. 2 is a side view of the antenna reflector of FIG. 1, and FIG. 3 is a front view of the antenna reflector in the folded state. In the deployed state, the antenna reflector is formed to have a disk shape, and the overall reflector surface is curved in accordance with a predetermined curvature so as to obtain an offset-feed. As shown in FIG. 1, the antenna reflector is formed by combining seven partial reflector portions, and its divided shape is symmetrical about a line A—A passing through the center of a circle. The antenna reflector comprises first to third reflector portions 11, 12*a* and 12*b*, and 13*a* to 13*d*.

The first reflector portion 11 is formed to have a cross shape along the line A—A, and it extends to a peripheral portion of the reflector in the vertical direction. In addition, a pair of supporting legs 14*a* and 14*b* for supporting the reflector to a spacecraft structure are mounted on the back surface of the central portion. Four leg portions 15 extend outward from predetermined portions at the both side of the central portion, as shown in FIG. 3. The second reflector portions 12*a* and 12*b* are connected to the both sides of the portion 11 by a plurality of hinges 16. The third reflector portions 13*a* and 13*b* are connected to both sides of each of the portion 12*a* by a plurality of hinges 17 and the portions 13*c* and 13*d* are connected to both sides of each of the portion 12*b* by a plurality of hinges 17, as shown in FIG. 1.

As shown in FIG. 3, the second reflector portions 12*a* and 12*b* are folded so that front surfaces face that of the portion 11. In the folded state, the distal ends of the portions 12*a* and 12*b* are adjacent to each other. As shown in FIG. 3, the third reflector portions 13*a* to 13*d* are folded so that back surfaces thereof face those of the corresponding portions 12*a* and 12*b*. In the folded state, the distal ends of the portions 13*a* to 13*d* are positioned near the closest portion between the portions 12*a* and 12*b*. Note that the hinges 16 and 17 incorporate elastic members such as coil springs (not shown) so as to apply a force in an deploying direction opposite to a folding direction of the portions 12*a*, 12*b* and 13*a* to 13*d*, i.e., the hinges are biased to open.

Figure 4:
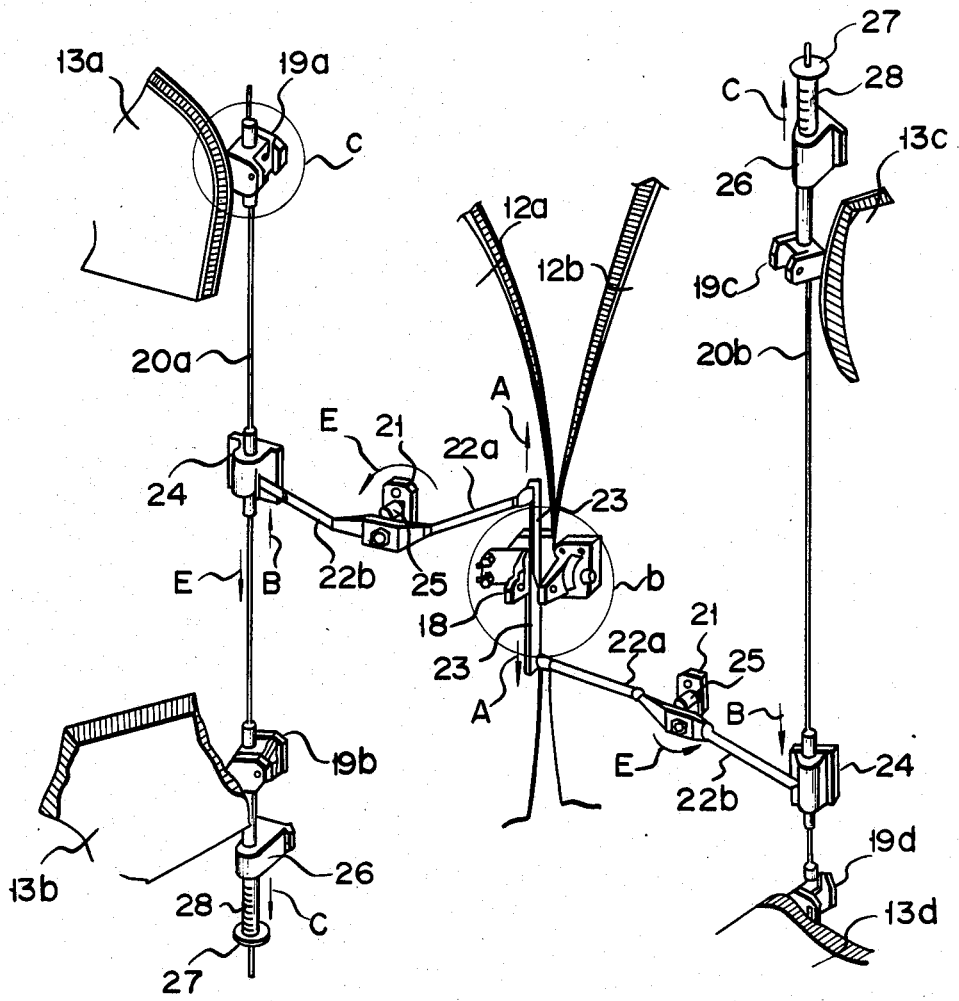
FIG. 4 is an enlarged, partially cutaway, perspective view of a portion "a" of FIG. 3.

The antenna reflector with the above-mentioned folding structure is folded as shown in FIG. 3 when mounted on a spacecraft, and the second and third reflector portions 12*a*, 12*b* and 13*a* to 13*d* are concentrically held by a releasing mechanism in a portion "a" in FIG. 3. The releasing mechanism is engaged with a plurality locking mechanism, and when the releasing mechanism is operated, connections of the reflector portions 12*a*, 12*b* and 13*a* to 13*d* are released. FIG. 4 is an enlarged, partial cutaway view of the portion "a" in FIG. 3, and FIG. 5 and FIGS. 6A and 6B show portions "b" and "c" as in FIG. 4. The locking and releasing mechanisms will be explained in detail hereinafter.

The releasing mechanism comprises the first locking mechanism 18 to keep the second reflector portions 12*a* and 12*b* in the folded state, and the second locking mechanisms 19*a* to 19*d* to connect the third reflector portions 13*a* to 13*d* to the second reflector portions 12*a* and 12*b* in the folded state.

Figure 5:
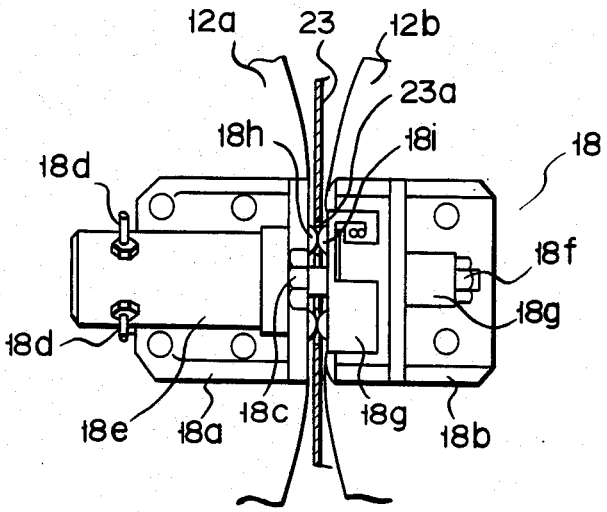
FIG. 5 is a view showing "a" first locking mechanism located at a portion "b" of FIG. 4.

FIG. 5 is a partial sectional view showing the first locking mechanism 18 in the portion "b" of FIG. 4. The locking mechanism 18 holds the portions 12*a* and 12*b* in the folded state, a first locking member 18*a* is mounted on the back surface of the portion 12*a*, a second locking member 18*b* is mounted on the back surface of the portion 12*b*, and the members 18*a* and 18*b* are connected by a bolt 18*c*. More specifically, the member 18*a* is provided with pyro portions 18*d*, and a bracket 18*e* including a separation nut and explosives (neither are shown). The member 18*b* is provided with a bracket 18*g* having a bolt catcher 18*f*. The bolt catcher 18*f* holds the bolt 18*c* whose threaded portion is screwed in the separation nut of the member 18*a* to be movable along its axial direction. Two pairs of projections 18*h* and 18*i* which project so that their respective distal ends are brought into contact with each other are formed on the brackets 18*e* and 18*g*, respectively.

Figure 6A:
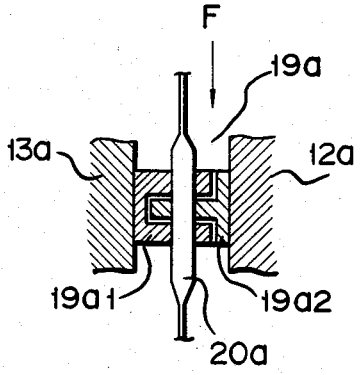
FIG. 6A is a front sectional view showing a structure of a second locking mechanism located at a portion "c" of FIG. 4.
Figure 6B:
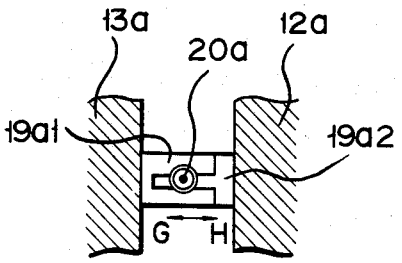
FIG. 6B is a top view of the second locking mechanism of FIG. 6A.

FIG. 6A is a side sectional view showing the second locking mechanism 19*a* in the portion "c" of FIG. 4, and FIG. 6B is a top view of the second locking mechanism 19*a* shown in FIG. 6A. The second locking mechanism 19*a* has a recess member 19*a*1 having a groove portion, and a projection member 19*a*2 aligned in the groove portion of the member 19*a*1. Hole and stripe portions (to be referred to as a lock portion hereinafter) through which a large-diameter portion of a cable 20*a* passes in the fitting state are formed in the members 19*a*1 and 19*a*2, respectively. That is, the second locking mechanism 19*a* couples the third reflector portion 13*a* to the second reflector portion 12*a* in the following manner. The member 19*a*1 is mounted on the back surface of the third reflector portion 13*a*, and the member 19*a*2 is mounted on the back surface of the portion 12*a*, so that the member 19*a*2 is aligned in the member 19*a*1 in the folded state of the portion 13*a*. Upon aligned the member 19*a*2 into the member 19*a*1, the large-diameter portion of the cable 20*a* is inserted in the lock portion, thereby locking the members 19*a*1 and 19*a*2 in the fitting state. Note that the members 19*a*1 and 19*a*2 cannot be locked by a small-diameter portion of the cable 20*a*.

The other second locking mechanisms 19*b* to 19*d* have the same structure as described above. The cable 20*a* has a large-diameter portion at two ends thereof. One end of the cable 20*a* is used as a locking member for the mechanism 19*a* for coupling the portions 13*a* and 12*a*, and the other end thereof is used as a locking member for the mechanism 19*b* for coupling the portions 13*b* and 12*a*. Similarly, a cable 20*b* is used as a locking member for the mechanisms 19*c* and 19*d*. These cables 20*a* and 20*b* are movable along their longitudinal directions, so that the respective large-diameter portions can be freely inserted in the lock portions of the mechanisms 19*a* to 19*d* upon movement thereof.

The structure of the releasing mechanism will be described hereinafter. In the releasing mechanism as shown in FIG. 4, since the same components are symmetrically provided at the sides of the portions 12*a* and 12*b*, the same reference numerals denote the same parts, and only the side of portion 12*a* will be described hereinafter.

A spring holder is mounted on the back surface of the portion 12*a* at a substantially central point between the first locking mechanism 18 and the cable 20*a*. A pair of arms 22*a* and 22*b* are pivotally mounted on a holder 21. A distal end portion of the arm 22*a* is coupled to an arm position holding plate 23, and that of the arm 22*b* is coupled to a cable holder 24 fixed at a central position of the cable 20*a*. Furthermore, a elastic member 25 is provided for the holder 21. The member 25 applies a biasing force to the arms 22*a* and 22*b* in the directions indicated by arrows A and B of FIG. 4, respectively. As shown in FIG. 5, a hole 23*a* having a diameter sufficient to receive the projections 18*h* and 18*i* is formed in the plate 23 so that the plate 23 is sandwiched between the projections 18*h* and 18*i* formed on the brackets 18*e* and 18*g* of the mechanism 18. On the other hand, one end portion of the cable 20*a* is inserted through a supporting member 26 fixed to the back surface of the portion 12*a*, and a stopper 27 is fixed to a portion of the cable 20*a* extending from the member 26. A spring 28 is inserted between the member 26 and the stopper 27. When the mechanisms 19*a* and 19*b* are engaged with each other, the spring 28 is compressed, and continuously applies a biasing force to the cable 20*a* in a direction indicated by arrow C in FIG. 4. The biasing force of the spring 28 is adjusted to be balanced with that applied to the arm 22*b* in the engaging state of the mechanisms 18, 19*a* and 19*b*.

Furthermore, the antenna reflector supporting mechanism for the deployable antenna reflector with the above arrangement by a spacecraft will be described with reference to FIGS. 7 and 8 hereinafter.

Figure 7:
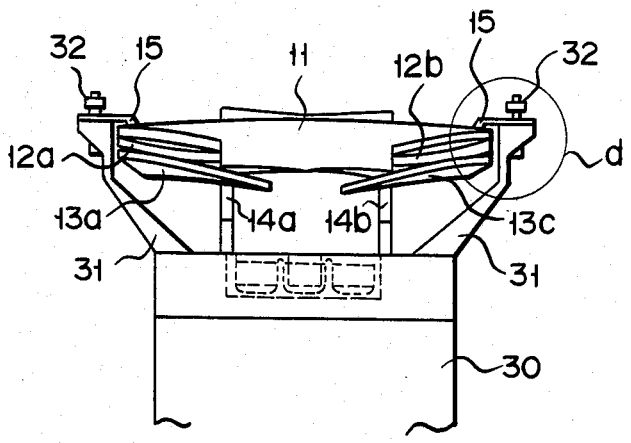
FIG. 7 is a top view showing a structure of an antenna supporting mechanism for mounting the antenna reflector in the folded state shown in FIG. 3 on a spacecraft.
Figure 8:
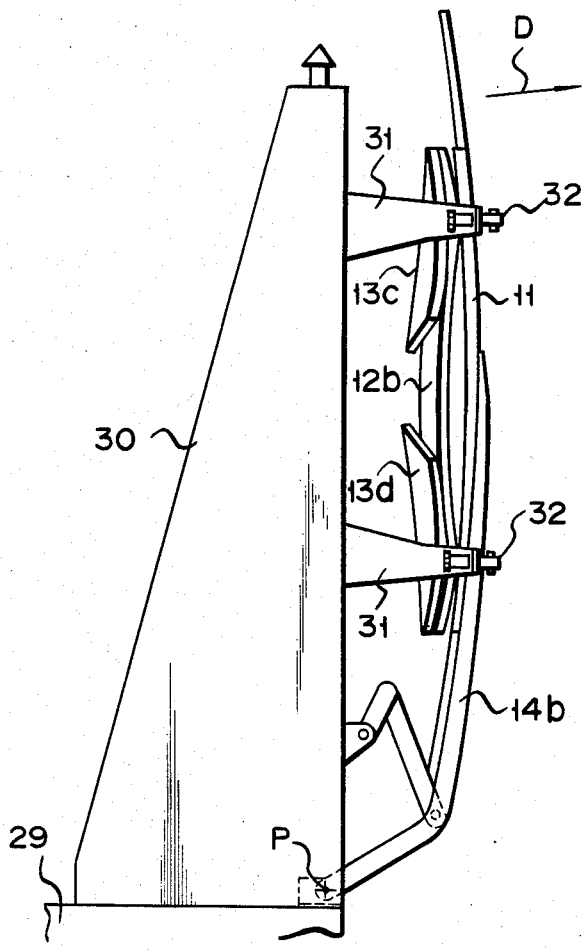
FIG. 8 is a side view of the antenna supporting mechanism of FIG. 7.

FIGS. 7 and 8 show a state wherein the antenna reflector in the folded state shown in FIG. 3 is mounted on the spacecraft, and FIG. 7 is a top view, and FIG. 8 is a side view. The antenna reflector is held by a tower-like antenna module 30 fixed to a spacecraft 29. More specifically, end portions of the supporting legs 14*a* and 14*b* mounted on the back surface of the portion 11 have a telescopic pantograph structure, and are provided on a bottom portion of the module 30 to be pivotal about a pivot shaft P within a predetermined range. The shaft P is provided with a elastic member such as coil spring (not shown), and the antenna reflector is continuously biased by a biasing force from this spring in a direction indicated by arrow D in FIG. 8. Four antenna supporting legs 31 having a predetermined height are provided at positions of the module 30 opposite to the four leg portions 15 projecting from the back surface of the portion 11 such that the antenna reflector is folded to the module 30 side against the biasing force of the above-mentioned coil spring. That is, the antenna reflector is held by coupling the four leg portions 15 to the distal ends of the legs 31.

Figure 9:
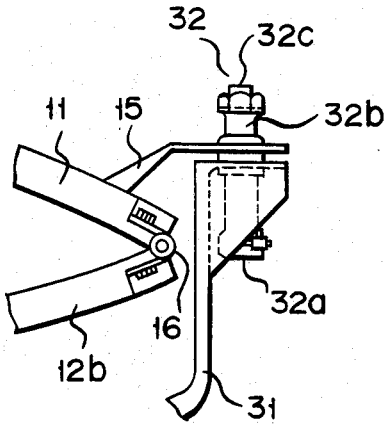
FIG. 9 is an enlarged view of a portion "d" of FIG. 7 showing a structure of a third locking mechanism.

Third locking mechanisms 32 couple the leg portions 15 to the legs 31. As shown in FIG. 9 as an enlarged view of the portion "d" in FIG. 7, in the same manner as the first locking mechanism 18, each third locking mechanism 32 comprises one bracket 32*a* including a pyro portion, separation nut and explosives (not shown), and another bracket 32*b* including a bolt catcher (not shown) for holding a bolt 32*c* to be movable along its axial direction. When the brackets 32*a* and 32*b* are threadably engaged by the bolt 32*c*, the leg portions 15 are coupled to the legs 31.

The operation of the deploying apparatus of the parabola antenna reflector with the above arrangement will be described hereinafter.

When the spacecraft is stored in a launch vehicle, the antenna reflector is held in the state shown in FIGS. 7 and 8. The spacecraft is launched from the launch vehicle after reaching a predeterming orbit in space. When the spacecraft reaches the orbit, a command from an earth station or an automatically generated deployed control signal is supplied to the first locking mechanism 18 and each third locking mechanism 32 so as to detonate the explosives through the pyro portions. The separation nuts of the mechanism 18 and 32 are divided due to the explosion, thereby removing the bolts. Thus, since the legs 31 and the leg portions 15 are disengaged from each other, the antenna reflector pivots at a predetermined angle about the pivot shaft P of the legs 14*a* and 14*b* in a direction indicated by arrow D in FIG. 8. Simultaneously, since the bolt is disengaged in the mechanism 18, the second reflector portions 12*a* and 12*b* are disengaged from each other.

At this time, the releasing mechanism is operated. That is, when the bolt 18*c* is removed in the first locking mechanism 18, since the plate 23 clamped between the projections 18*h* and 18*i* of the brackets 18*e* and 18*g* is released, the arms 22*a* and 22*b* are released from the biasing force of the elastic member 25 such as coil spring and pivot in the direction indicated by arrow E in FIG. 4. The cables 20*a* and 20*b* are moved in the direction indicated by arrow C. For this reason, since the large-diameter portions of the cables 20*a* and 20*b* locking the mechanisms 19*a* to 19*d* are disengaged therefrom, engagement of the mechanisms 19*a* to 19*d* is released. For example, in the case of the mechanism 19*a*, the cable 20*a* is moved in the direction indicated by arrow F, as shown in FIGS. 6A and 6B, and the large-diameter portion is unlocked from the lock portion. Then, the recess and projection members 19*a*1 and 19*a*2 are moved by the biasing force of the elastic member built in the hinge 17 in the directions indicated by arrows G and H, respectively, thus releasing the fitting state of the members 19*a*1 and 19*a*2.

When the folding state of the first locking mechanism 18 is released, since the second locking mechanisms 19*a* to 19*d* are also released in response thereto, the portions 12*a* and 12*b* begin to deploy due to a biasing force of the coil spring built in the hinge 16. Simultaneously, the portions 13*a* to 13*d* begin to deploy due to a biasing force of the elastic member built in the hinge 17. Finally, the reflector is deployed to a disk-shaped reflector, as shown in FIG. 1. In this case, since the holding state of the third locking mechanism 32 is simultaneously released, the antenna reflector is set in the deployed state at a predetermined angle with respect to the spacecraft.

In the antenna reflector with the above-mentioned deploying apparatus, the seven reflector portions can be folded three times toward a curved surface side, the overall reflector can become very compact in size, and particularly, as thin as possible, thus achieving good storage profile in a launch vehicle. That is, the reflector can be stored to have a total thickness substantially equal to the original thickness of the reflector. When a plurality of antenna reflectors are mounted on the spacecraft, upper and side surfaces of the spacecraft can be effectively utilized. Furthermore, locking members are released by removing bolts by detonation of explosives by pyro portions, the reflector portions of the reflector can be held in a locked state with sufficient mechanical strength to withstand the vibration and shock of the launching of the launch vehicle, and can be reliably released when the antenna is deployed.

What is claimed is:

1. A deployable antenna reflector apparatus, comprising:

a cross-shaped first reflector portion which is a part of a divided disk-shaped reflector and which extends in a longitudinal direction to a peripheral portion of said reflector;

a pair of second reflector portions which are parts of said divided disk-shaped reflector and are axially supported opposite to each other at two sides of said first reflector portion so as to be biased to open and to be deployable;

two pairs of third reflector portions which are parts of said divided disk-shaped reflector and which are axially supported opposite to each other at two sides of each of said pair of second reflector portions so as to be biased to open and to be deployable;

a first locking mechanism for holding said pair of second reflector portions in a folded state;

second locking mechanisms for holding said two pairs of third reflector portions in a folded state; and a releasing mechanism for releasing said second locking mechanisms subsequently after said pair of second reflector portions begin to deploy when said first locking mechanism is released.

2. An apparatus according to claim 1, wherein said first locking mechanism comprises a first locking member mounted on one of said second reflector portions, incorporating an explosive and having a pyro for detonating said explosive, a second locking member which is mounted at a position of the other second reflector portion opposite to said first locking member and has a bolt catcher, and a bolt for coupling said first and second locking members; and said explosive is exploded in response to detonation of said pyro, and said bolt is removed by an explosive force, thereby releasing a coupling state of said first and second locking members.

3. An apparatus according to claim 1, wherein said second locking mechanisms comprise recess members mounted on said third reflector portions, projection members which are mounted at positions of said pair of second reflector portions facing said recess members and are fitted in said recess members, and locking members for holding said recess and projection members in a fitting state; and the fitting state of said recess and projection members can be released by removing said locking members.

4. An apparatus according to claim 1, wherein said first locking mechanism comprises a first locking member mounted on one of said second reflector portions, incorporating an explosive, and having a pyro for detonating said explosive, a second locking member which is mounted at a position of the other second reflector portion opposite to said first locking member and has a bolt catcher, and a bolt for coupling said first and second locking members;

said explosive is exploded by detonation of said pyro, and said bolt is removed by an explosive force, thereby releasing a coupling state of said first and second locking members;

said second locking mechanisms comprise recess members mounted on said third reflector portions, projection members which are mounted at positions of said pair of second reflector portions facing said recess members and are fitted in said recess members, and locking members for holding said recess and projection members in a fitting state;

the fitting state of said recess and projection members can be released by removing said locking members;

said releasing mechanism comprises a supporting plate clamped between said first and second locking members of said first locking mechanism, a cable for connecting in an engagement/disengagement direction said locking members of said second locking mechanisms which couple said third reflector portions to the corresponding second reflector portions, an arm, pivotal about a central point thereof as a fulcrum, for coupling said supporting plate and said cable, a first elastic member for applying a biasing force to said arm and said cable in an engagement direction of said locking members, and a second elastic member for applying to said cable, a biasing force balanced with the biasing force of said first elastic member, in a disengagement direction of said locking members in a locked state of said first and second locking mechanisms; and when the coupling state of said first and second locking members of said first locking mechanism is released, said supporting plate is disengaged, said arm pivots, said first elastic member loses the biasing force, said cable is moved by the biasing force of said second elastic member, and said locking member of said second locking mechanisms is disengaged from said recess and projection members, thereby releasing the coupling state of said second locking mechanisms.

5. A deployable antenna reflector apparatus, comprising:

a cross-shaped first reflector portion which is a part of a divided disk-shaped reflector and which extends in a longitudinal direction to a peripheral portion of said reflector;

a pair of second reflector portions which are parts of said divided disk-shaped reflector and are axially supported opposite to each other at two sides of said first reflector portion so as to be biased to open and to be deployable;

two pairs of third reflector portions which are parts of said divided disk-shaped reflector and which are axially supported opposite to each other at two sides of each of said pair of second reflector portions so as to be biased to open and to be deployable;

a first locking mechanism for holding said pair of second reflector portions in a folded state;

second locking mechanisms for holding said two pairs of third reflector portions in a folded state;

a releasing mechanism for releasing said second locking mechanisms subsequently after said pair of second reflector portions begin to deploy when said first locking mechanism is released;

supporting legs mounted on a back surface of said first reflector portion and having an end portion mounted on antenna mounting equipment to be pivotal within a predetermined angular range;

an elastic member for applying a biasing force in a direction in which said supporting legs are separated from said antenna mounting equipment; and a third locking mechanism for holding said disk-shaped reflector folded by said first and second locking mechanisms while laying said reflector at the side of said antenna mounting equipment against the biasing force of said elastic member.

6. An apparatus according to claim 5, wherein said first locking mechanism comprises a first locking member mounted on one of said second reflector portions, incorporating an explosive and having a pyro for detonating said explosive, a second locking member which is mounted at a position of the other second reflector portion opposite to said first locking member and has a bolt catcher, and a bolt for coupling said first and second locking members; and said explosive is exploded in response to the detonation of said pyro, and said bolt is removed by an explosive force, thereby releasing the coupled state of said first and second locking members.

7. An apparatus according to claim 5, wherein said second locking mechanisms comprise recess members mounted on said third reflector portions, projection members which are mounted at positions of said pair of second reflector portions facing said recess members and are fitted in said recess members; and locking members for holding said recess and projection members in a fitting state; and the fitting state of said recess and projection members can be released by removing said locking members.

8. An apparatus according to claim 5, wherein said first locking mechanism comprises a first locking member mounted on one of said second reflector portions, incorporating an explosive, and having a pyro for detonating said explosive, a second locking member which is mounted at a position of the other second reflector portion opposite to said first locking member and has a bolt catcher, and a bolt for coupling said first and second locking members;

said explosive is exploded by detonation of said pyro, and said bolt is removed by an explosive force, thereby releasing the coupled state of said first and second locking members;

said second locking mechanisms comprise recess members mounted on said third reflector portions, projection members which are mounted at positions of said pair of second reflector portions facing said recess members and are fitted in said recess members, and locking members for holding said recess and projection members in a fitted state;

the fitted state of said recess and projection members can be released by removing said locking members;

said releasing mechanism comprises a supporting plate clamped between said first and second locking members of said first locking mechanism, a cable for connecting in an engagement/disengagement direction said locking members of said second locking mechanisms which couple said third reflector portions to the corresponding second reflector portions, an arm, pivotal about a central point thereof as a fulcrum, for coupling said supporting plate and said cable, a first elastic member for applying a biasing force to said arm and said cable in the engagement direction of said locking members, and a second elastic member for applying to said cable, a biasing force balanced with the biasing force of said first elastic member, in a disengagement direction of said locking members in a locked state of said first and second locking mechanisms; and when the coupling state of said first and second locking members of said first locking mechanism is released, said supporting plate is disengaged, said arm pivots, said first elastic member loses the biasing force, said cable is moved by the biasing force of said second elastic member, and said locking members of said second locking mechanisms are disengaged from said recess and projection members, thereby releasing the coupling state of said second locking mechanisms.

9. An apparatus according to claim 5, wherein said third locking mechanism comprises a plurality of leg portions provided on a back surface of said first reflector portion so as to extend outward in a state wherein said disk-shaped reflector is folded, a plurality of antenna supporting legs provided at positions of said antenna mounting equipment opposite to said plurality of leg portions to have a predetermined height in a state wherein said disk-shaped reflector is laid at the side of said antenna mounting equipment, and a plurality of holding members for coupling said plurality of leg portions to the corresponding antenna supporting legs, the coupling state of said holding member being released at the same time when said first locking mechanism is released.

10. An apparatus according to claim 9, wherein each of said holding members comprises a fifth locking member incorporating an explosive and having a pyro for detonating said explosive, a sixth locking member having a bolt catcher, and a bolt for coupling said first and second locking members while clamping said leg portions and said antenna supporting legs, and said explosive is exploded by detonation of said pyro, and said bolt is removed by an explosive force, thereby releasing the coupled state of said fifth and sixth locking members.

* * * * *